US005598600A

United States Patent [19]

Stegens

[11] Patent Number: 5,598,600

[45] **Date of Patent: *Feb. 4, 1997**

[54] BRUSHROLL

[75] Inventor: Alfred H. Stegens, Olmsted Township, Ohio

[73] Assignee: The Scott Fetzer Company, Westlake, Ohio

[ * ] Notice: The term of this patent shall not extend beyond the expiration date of Pat. No. 5,465,451.

[21] Appl. No.: 478,478

[22] Filed: Jun. 7, 1995

Related U.S. Application Data

[60] Division of Ser. No. 101,634, Aug. 4, 1993, Pat. No. 5,465,451, which is a continuation-in-part of Ser. No. 998, 791, Dec. 29, 1992, Pat. No. 5,272,785, which is a continuation-in-part of Ser. No. 887,420, May 20, 1992, Pat. No. 5,193,243, which is a continuation of Ser. No. 456,348, Dec. 26, 1989, abandoned.

[51] Int. Cl.[6] ..... A46B 13/02

[52] U.S. Cl. ..... 15/179; 15/41.1; 15/391; 15/392; 384/489; 492/29; 492/47

[58] Field of Search ..... 15/41.1, 42–46, 15/48, 48.1, 48.2, 179, 181–183, 383, 384, 389, 391, 392; 384/489; 492/29, 47

[56] References Cited

U.S. PATENT DOCUMENTS

| | | | |
|---|---|---|---|
| 600,413 | 3/1898 | Drew | 15/41.1 |
| 733,904 | 7/1903 | Dodd | 15/48.1 |
| 862,053 | 7/1907 | Cobb | 15/392 |
| 1,104,270 | 7/1914 | Pack . | |
| 1,286,321 | 12/1918 | Hoover . | |
| 1,582,652 | 4/1926 | Albrecht . | |
| 1,599,991 | 9/1926 | Demaree | 15/182 |
| 1,680,741 | 8/1928 | Lang . | |
| 1,681,453 | 8/1928 | Wright | 15/179 |
| 1,815,084 | 7/1931 | White . | |
| 1,878,856 | 9/1932 | Jones . | |
| 1,888,339 | 11/1932 | White | 15/392 |

(List continued on next page.)

FOREIGN PATENT DOCUMENTS

| | | |
|---|---|---|
| 561960 | 11/1957 | Belgium . |
| 731045 | 5/1932 | France . |
| 1012107 | 7/1952 | France . |
| 228076 | 3/1909 | Germany . |
| 1080356 | 4/1960 | Germany . |
| 3039167 | 5/1982 | Germany . |
| 3342833 | 6/1985 | Germany . |
| 671202 | 10/1964 | Italy . |
| 52-46671 | 4/1977 | Japan . |
| 34322 | 5/1905 | Switzerland . |
| 1048961 | 8/1965 | Switzerland . |
| 390746 | 8/1965 | Switzerland . |
| 2628 | of 1898 | United Kingdom . |
| 17209 | of 1907 | United Kingdom . |
| 27325 | of 1907 | United Kingdom . |
| 25489 | of 1910 | United Kingdom . |
| 474619 | 11/1937 | United Kingdom . |
| 1206844 | 9/1970 | United Kingdom . |
| 2073850 | 10/1981 | United Kingdom . |
| 2086717 | 5/1982 | United Kingdom . |

*Primary Examiner*—Mark Spisich
*Attorney, Agent, or Firm*—Watts, Hoffmann, Fisher & Heinke Co. L.P.A.

[57] ABSTRACT

An improved vacuum cleaner brushroll including a tufted spindle supported by end assemblies. The end assemblies have bearings that rotatably mount the spindle in a vacuum cleaner nozzle. Rotation of the spindle is effective to pick up debris. The improvement comprises the spindle being a hollow tubular member. Each of the end assemblies includes a plug fitted into a respective axial end of the spindle. The plug or spindle has ribs in a cylindrical surface which engage the material of the other of the plug or spindle to resist rotation between the spindle and the plug. One of the bearings has a first portion operably connectable with the plug. A relatively rotatable second portion of the bearing is operably connectable with a brushroll mounting structure of the vacuum cleaner nozzle.

9 Claims, 4 Drawing Sheets

U.S. PATENT DOCUMENTS

| | | | |
|---|---|---|---|
| 1,891,503 | 12/1932 | Smellie . | |
| 1,900,889 | 3/1933 | Becker | 15/389 |
| 1,919,067 | 7/1933 | Lang et al. . | |
| 1,972,796 | 9/1934 | Schaad . | |
| 1,973,679 | 9/1934 | Bass | 15/392 |
| 1,999,696 | 4/1935 | Kitto . | |
| 2,014,626 | 9/1935 | Moorhead . | |
| 2,055,264 | 9/1936 | Schottle . | |
| 2,176,769 | 10/1939 | Martinet . | |
| 2,226,581 | 12/1940 | Richardson | 15/41.1 |
| 2,263,762 | 11/1941 | Dow et al. . | |
| 2,271,553 | 2/1942 | Smellie | 15/182 |
| 2,281,863 | 5/1942 | Smellie | 15/182 |
| 2,372,404 | 3/1945 | Taylor | 15/383 |
| 2,441,624 | 5/1948 | Elliott | 15/179 |
| 2,707,792 | 5/1955 | Waller . | |
| 2,734,211 | 2/1956 | Vance . | |
| 2,757,406 | 8/1956 | Decker | 15/392 |
| 2,907,063 | 10/1959 | Jones | 15/182 |
| 3,198,318 | 8/1965 | Brown . | |
| 3,259,442 | 7/1966 | Boghosian . | |
| 3,284,830 | 11/1966 | Kroll | 15/179 |
| 3,346,896 | 10/1967 | Arones . | |
| 3,368,231 | 2/1968 | Kravos et al. . | |
| 3,521,932 | 7/1970 | Beebe . | |
| 3,550,231 | 12/1970 | Rosenkranz et al. | 492/47 |
| 3,550,974 | 12/1970 | Kupchick . | |
| 3,566,497 | 3/1971 | Hamlen . | |
| 3,737,937 | 6/1973 | Nordeen | 15/182 |
| 3,774,982 | 3/1973 | Nakamura et al. . | |
| 3,833,961 | 9/1974 | Fortman et al. . | |
| 3,879,786 | 4/1975 | Larkin . | |
| 3,943,593 | 3/1976 | Gould et al. | 15/179 |
| 3,959,847 | 6/1976 | Kaulig et al. . | |
| 4,130,911 | 12/1978 | Clark | 15/179 |
| 4,209,872 | 7/1980 | Maier | 15/179 |
| 4,209,873 | 7/1980 | Schaefer | 15/182 |
| 4,238,870 | 12/1980 | Fahlen | 15/389 |
| 4,361,929 | 12/1982 | Jinkins | 15/355 |
| 4,373,759 | 2/1983 | Greener et al. . | |
| 4,403,372 | 9/1983 | Keane et al. | 15/339 |
| 4,429,430 | 2/1984 | Lyman | 15/182 |
| 4,527,915 | 7/1985 | Ikariishi et al. . | |
| 4,624,025 | 11/1986 | Kaulig et al. | 15/41.1 |
| 5,193,243 | 3/1993 | Stegens | 15/179 |
| 5,272,785 | 12/1993 | Stegens | 15/179 |
| 5,373,603 | 12/1994 | Stegens | 15/179 |

BRUSHROLL

This is a divisional of application Ser. No. 08/101,634 filed Aug. 4, 1993, U.S. Pat. No. 5,465,451, which is a continuation-in-part of U.S. patent application No. 07/998,791, filed Dec. 29, 1992, U.S. Pat. No. 5,272,785, which is a continuation-in-part of U.S. patent application No. 07/887,420, filed May 20, 1992, now U.S. Pat. No. 5,193,243, which is a continuation of U.S. patent application No. 07/456,348, filed Dec. 26, 1989, abandoned.

BACKGROUND OF THE INVENTION

1. Technical Field

The present invention relates generally to vacuum cleaners. In particular, the present invention relates to a vacuum cleaner brushroll including an improved spindle and improved end assemblies for rotatably mounting the spindle in a vacuum cleaner nozzle.

2. Background Art

Prior art vacuum cleaner brushrolls generally include an elongated spindle rotatably supported in various constructions at either end by bearings mounted to the sides of a vacuum cleaner nozzle. The spindle is rotated by a belt operably connected with a motor. A plurality of tufts of brush bristles or beater bar elements project from an outer surface of the spindle. As the brushroll rotates, the brush tufts or beater bar elements contact the surface of a carpet and loosen dirt or debris from carpet fibers. The brush tufts or beater bar elements are generally mounted in a helical pattern on the brushroll to agitate the carpet fibers as the vacuum cleaner moves over the carpet surface and dislodge dirt and debris. Suction within the nozzle then moves the dirt and debris to a filter/storage area of the vacuum cleaner.

The spindles of prior art brushrolls are often fabricated from a piece of wood or from metal formed into a tube or cylinder and often include a long continuous metal shaft extending through the spindle. A disadvantage associated with prior art wood spindles, either solid or with a central opening, is that wood is becoming more difficult to obtain. This difficulty in obtaining wood makes it increasingly expensive. A disadvantage associated with the use of metal spindles is the relative difficulty in fabricating the spindle and in attaching tufting to the spindle to extend from an outer surface of the spindle. A disadvantage in using the long continuous metal shaft is the unnecessary weight added to the overall weight of the brushroll assembly.

Many prior art spindles, because of their structure, material or complexity, do not easily lend themselves to fabrication by modern manufacturing methods, such as by molding from a readily available and relatively inexpensive material, such as plastic. Thus, there remains a need for a brushroll which is relatively lightweight and which is relatively simple and relatively inexpensive to fabricate and assemble.

SUMMARY OF THE INVENTION

The present invention is directed to an improved vacuum cleaner brushroll offering advantages over prior art brushrolls having wood or metal spindles. The brushroll, embodying the present invention, is relatively simple and inexpensive to fabricate and assemble and is relatively lightweight.

An improved vacuum cleaner brushroll, embodying the present invention, includes a tufted spindle supported at axially opposite ends by a pair of substantially identical end assemblies. Each of the end assemblies has a bearing for rotatably mounting the spindle in a vacuum cleaner nozzle. Rotation of the spindle is effective to pick up dirt and debris. The improvement includes the spindle being a hollow tubular member. Each of the end assemblies includes a plug fitted into a respective axial end of the spindle. The plug or spindle has ribs in a surface which engage the material of the other of the plug or the spindle to resist rotation between the plug and the spindle. One of the bearings has a first portion operably connectable with the plug. A relatively rotatable second portion of the bearing is operably connectable with a brushroll mounting structure of the vacuum cleaner nozzle.

The spindle is preferably formed as one piece from a plastic material. The plug is also preferably formed as one piece from a plastic material and has a cylindrically shaped outer surface with the ribs formed thereon. In one embodiment of the invention, the plug includes means permitting arcuate portions of the outer surface of the plug to radially contract as the plug is received in the axial end of the spindle. The means also permits radial expansion of the arcuate portions and biases the arcuate portions of the outer surface against the spindle. The plug also includes a surface defining a cavity for receiving the first portion of the bearing. The second portion of the bearing is mounted on a shaft of an end pin mounting member which has a base portion connectable with the vacuum cleaner nozzle. The end pin mounting member is integrally formed as one piece.

In another embodiment of the invention, a stub shaft is provided. The plug includes a bore. The stub shaft is made from a metal material having a ribbed portion in fixed frictional engagement with the surface defining the bore in the plug. The first portion of the bearing is received on another portion of the stub shaft extending from the plug. The second portion of the bearing is received in an end cap which is connectable with the brushroll mounting structure in the vacuum cleaner nozzle.

In another embodiment of the invention, the plug and stub shaft are integrally formed as a one piece construction from a plastic material. The first portion of the bearing is received on a portion of the stub shaft extending from the plug. A bore is formed in the one piece construction. A pin member is inserted into the bore to stiffen the stub shaft and resist bending.

In yet another embodiment of the invention, a flange portion of the plug is integrally formed as one piece with the plug. The flange portion is for engaging an end surface of the spindle and has an outside diameter greater than the outside diameter of an axial end portion of the spindle. A recess in the plug at least partially receives the bearing and protects the bearing from debris. A wall may extend from the flange portion to further protect the bearing from debris.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION OF PREFERRED EMBODIMENTS

Figure 1:
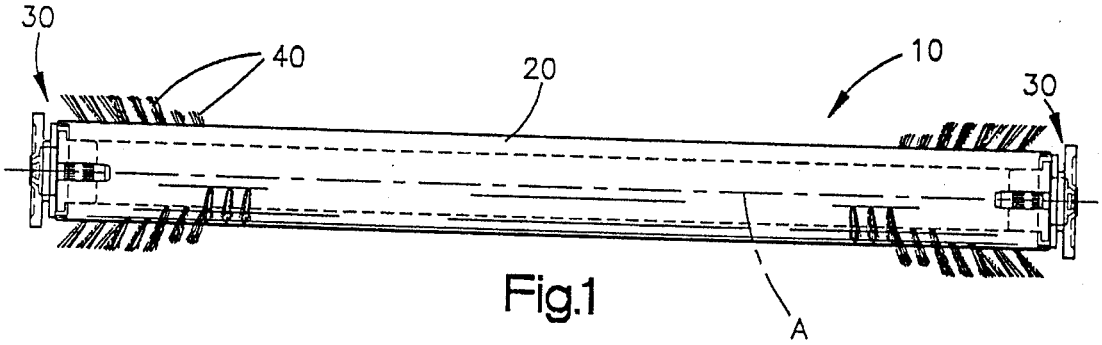
FIG. 1 is a longitudinal side view of a brushroll according to one embodiment of the present invention.

A brushroll 10 according to one embodiment of the present invention for use in a vacuum cleaner (not shown), is illustrated in FIG. 1. The brushroll 10 includes an elongated spindle 20 supported for rotation in a nozzle (not shown) of the vacuum cleaner. The spindle 20 is rotatably supported at axially opposite ends by a pair of substantially identical end assemblies 30. Each end assembly 30 is operably connectable with a respective brushroll mounting structure (not shown) in the vacuum cleaner nozzle.

The brushroll 10 includes brush tufting 40 extending from the spindle 20. The tufting 40 is suitably arranged along the spindle 20, such as in a direction parallel to a longitudinal central axis A of the spindle or helically relative to the axis A. The tufting 40 may be attached to the spindle 20 by any suitable method, such as by being inserted into holes in the spindle in the same manner as tufting is conventionally attached to known wood spindles. During rotation of the spindle 20 the tufting 40 is effective to loosen and pick up dirt and debris from a surface, such as carpeting, which is being cleaned by the vacuum cleaner. The dirt and debris tend to move axially toward the end assemblies 30.

The spindle 20 (FIGS. 1, 2 and 3) of the brushroll 10 is formed as a hollow tubular member and has a substantially constant cross-section. Each axial end portion of the spindle 20 is Substantially identical. Preferably, the spindle 20 is formed as one piece from plastic material by a suitable process, such as molding. The spindle 20 includes an inner cylindrical surface 50 (FIGS. 2 and 3) and a coaxially disposed outer cylindrical surface 52. The inner cylindrical surface 50 extends continuously and completely through the length of the spindle 52.

As shown, the spindle 20 may include a plurality of continuous and longitudinally extending reinforcing ribs 54 circumferentially arrayed about the inner cylindrical surface 50 to add some strength and further resist bending of the spindle. The reinforcing ribs 54 are spaced axially inward of an axial end surface 56 of the spindle 20. The reinforcing ribs 54 are preferably included when a dowel portion (not shown) of the spindle 20 is located away from the axial ends 56 of the spindle. The dowel portion is for engagement by a drive belt to rotate the spindle 20. The reinforcing ribs 54 are generally not necessary when the dowel portion is located near an axial end 56 of the spindle 20. The construction of the spindle 20, thus, is relatively lightweight, lends itself to a molding operation, and is strong enough for its intended use.

By way example, if the dowel portion is formed centrally away from the axial end surfaces 56 of the spindle 20, the axial end portions of the spindle and end assemblies 30 are identical. However, if the dowel portion is formed near an axial end surface 56 of the spindle 20, the axial opposite end portions of the spindle typically have different thicknesses and require slightly different end assemblies 30 to accommodate the thickness difference in the spindle end portions. For example, one axial end portion of the spindle 20 may have a wall thickness taken in radial direction which is twenty-five to thirty percent greater than the wall thickness of the other axial end portion. The outside diameters of the outer cylindrical surface 52 at both end portions of the spindle 20 are the same. A component of one end assembly 30 will have to compensate for the change in thickness by a size difference. Otherwise, the axial end portions of the spindle 20 and the end assemblies 30 are identical in appearance, structure and function.

Figure 3:
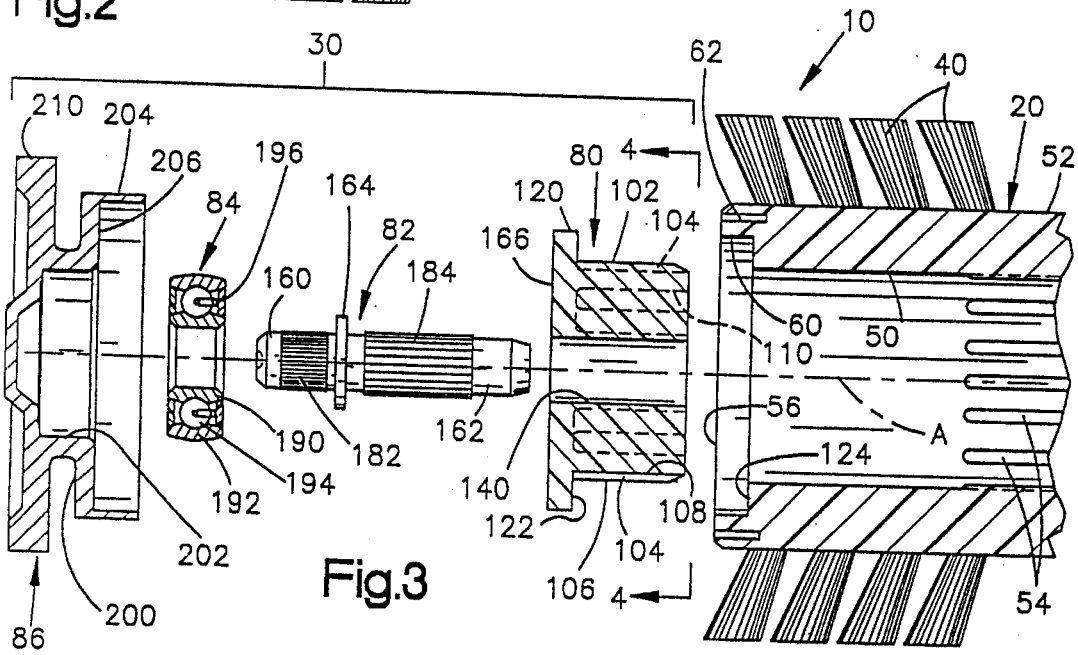
FIG. 3 is an exploded sectional view of the components of the end portion of the brushroll illustrated in FIG. 2.

The spindle 20 has an annular recess 60 (FIG. 3) formed in the axial end surface 56 of the spindle and coaxially arranged with the inner cylindrical surface 50. The diameter of the annular recess 60 is slightly larger than the diameter of the inner cylindrical surface 50. An annular groove 62 is also formed in the axial end surface 56 of the spindle 20 radially outward of the annular recess 60. The depth of the annular groove 62 is illustrated in FIG. 3 as being slightly deeper that the depth of the annular recess 60. It will be apparent that the depths of either or both of the annular recess 60 or annular groove 62 may be modified to any suitable depth.

Figure 2:
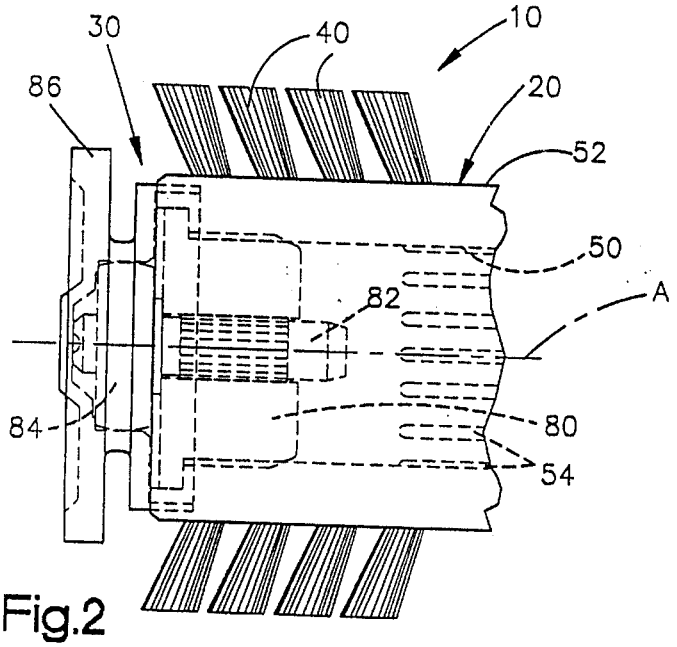
FIG. 2 is an enlarged view of an assembled end portion of the brushroll illustrated in FIG. 1.

Each end assembly 30 (only one of which is shown in FIGS. 2 and 3) of the brushroll 10 includes a plug 80, a stub shaft 82, a bearing 84 and an end cap 86. The plug 80 of the end assembly 30 is fitted into a respective axial end portion of the spindle 20, as illustrated in FIGS. 1 and 2. The plug 80 is preferably a one piece integral component made from a plastic material by injection molding. The plug 80 has a generally cylindrical outer surface 102 (FIG. 3) extending for the majority of the axial length of the plug 80. It is the outer diameter of the cylindrical outer surface 102 of one of the plugs 80 in the end assemblies 30 that changes to accommodate different wall thicknesses of axial end portions of the spindle 20, when present.

A plurality of ribs 104 (FIGS. 3 and 4) extend in a direction longitudinally of the plug 80 over the entire periphery of the outer surface 102. The ribs 104 may be in the form of suitable splines, knurls or the like. Each rib 104 of the plug 80 has a crown 106 and root 108. The crown 106 is the radial outermost portion of the rib 104. The root 108 is the radial innermost portion of the rib 104. The radial extent to the peak of each crown 106 of a rib 104 is preferably slightly greater than the radius of the inner cylindrical surface 50 of the spindle 20. The root 108 of each rib 104 has a radial extent which is preferably slightly less than the radius of the inner cylindrical surface 50 of the spindle 20. It will be apparent that ribs could be formed on the inner surface 50 of the spindle 20 to engage a smooth outer cylindrical surface 102 of the plug 80. The plug 80 includes a plurality of longitudinally extending passages 110 in a circumferential array and located inwardly of the outer cylindrical surface 102. The passages 110 provide a relatively lightweight plug 80 with a relatively constant material thickness for uniform cooling after molding in order to minimize distortion.

When the plug 80 is forced into the axial end portion of the spindle 20, the crown 106 of each rib 104 deformably and frictionally engages around the entire periphery of the inner cylindrical surface 50 for substantially the entire axial extent of the outer cylindrical surface 102. Since the radial extent of the crown 106 of each rib 104 is slightly larger than the radius of the inner cylindrical surface 50, the crown "bites" into the plastic material of the spindle 20 and deforms and displaces some of the plastic material towards the root 108 of the rib. The plug 80 is positively connected to the spindle 20 by the engaged deformation and displacement of the plastic material of the spindle to resist or prevent relative rotation between the plug and the spindle.

The illustrated plug 80 (FIG. 3) also includes a flange portion 120. The flange portion 120 includes an axial end surface 122 which engages an axial end surface 124 of the annular recess 60 of the spindle 20 during the assembly operation. The flange portion 120 assures that the plug 80 will not be forced axially inwardly beyond a predetermined location relative to the spindle 20. The plug 80 also includes a surface defining a bore 140. The bore 140 is located in the plug 80 coaxially relative to the outer cylindrical surface 102 so the plug is disposed coaxially along the axis A after the plug is inserted into the spindle 20.

The stub shaft 82 of the end assembly 30 is preferably made from a metal, such as steel. The overall length or axial extent of the stub shaft 82 is relatively shorter than the length of the spindle 20. For example, as illustrated in FIG. 1, two separate and identical stub shafts 82 are shown. Each stub shaft 82 has an overall length not more than about ten percent of the length of the spindle 20. These relatively short stub shafts 82 minimize total weight of the brushroll 10 yet provide a very strong end assembly 30 for rotatably mounting the brushroll.

The stub shaft 82 (FIG. 3) includes a first axial end portion 160, a second axial end portion 162 and a flange 164 located between the end portions. The first axial end portion 160 has a generally cylindrical shape and an outer surface that has a plurality of ribs 182, such as splines or knurls around the entire periphery. The second axial end portion 162 is also cylindrically shaped with a diameter substantially equal to the diameter of the first axial end portion 160. The second axial end portion 162 has an outer surface with a plurality of ribs 184, such as splines or knurls, around the entire periphery.

The second axial end portion 162 of the stub shaft 82 has a diameter which permits the ribs 184 to frictionally engage and deform the plastic material of the plug 80 around the entire inner circumference of the bore 140. The frictional engagement is along a substantial length of the second axial end portion 162 to fixedly attach the stub shaft 82 to the plug 80 and resist relative rotation. The flange 164 engages an axial end surface 166 of the plug 80 during assembly to assure proper relative axial location and prevent the stub shaft 82 from extending too far within the plug. The first axial end portion 160 of the stub shaft 82, thus, extends from the plug 80 and from the spindle 20 after the plug is inserted into the spindle and the stub shaft is inserted into the plug.

The bearing 84 of the end assembly 30 is received on the first axial end portion 160 of the stub shaft 82 extending from the plug 80. The bearing 84 provides relatively low frictional resistance to rotation of the spindle 20. The bearing 84 has an inner bearing portion 190 with an inner cylindrical surface for receiving the first axial end portion 160 of the stub shaft 82. The ribs 182 on the stub shaft 82 frictionally engage the inner cylindrical surface of the inner bearing portion 190 to resist relative rotation. The bearing 84 also includes an outer bearing portion 192 that is rotatable relative to the inner bearing portion 190. A plurality of balls 194 are located between the inner bearing portion 190 and outer bearing portion 192 in races. An elastomeric annular seal 196 is provided on each side of the bearing 84 between the inner and outer bearing portions 190, 192. The seals 196 prevent debris from entering the close fitting areas between the balls 194 and the races of the inner and outer bearing portions 190, 192.

The end cap 86 of the end assembly 30 is receivable in a brushroll mounting structure (not shown) connected to the vacuum cleaner nozzle for operably connecting the end cap with the vacuum cleaner nozzle. A mounting portion 210 of the end cap 86 engages the brushroll mounting structure in the vacuum cleaner nozzle to rotatably mount the brushroll 10 in the vacuum cleaner. The end cap 86 has a central annular groove portion 200 which forms a spool area for collecting threads or other debris. The end cap 86 also includes a bearing cavity 202 which receives the bearing 84 and frictionally engages the outer bearing portion 192. Thus, the spindle 20 is rotatable relative to the end cap 86 and vacuum cleaner nozzle while the outer bearing portion 192 is fixed to the end cap and the inner bearing portion 190 is fixed to the stub shaft 82.

The end cap 86 also includes a tubular portion 204 extending axially from an axial end surface 206 and is integrally formed as one piece with the end cap. The tubular portion 204 of the end cap 86 is receivable in the annular groove 62 in the end surface 56 of the spindle 20 to form a seal. The seal prevents any loose threads, dirt or debris resulting from rotation of the spindle 20 from entering the bearing 84 and causing damage to parts of the bearing.

Preferably during an assembly operation, the stub shaft 82 is first inserted into the plug 80. The plug 80 is then inserted into the opening defined by the inner cylindrical surface 50 in the end portion of the spindle 20. The bearing 84 may be placed on the stub shaft 82 either before or after the stub shaft is inserted into the plug 80. The end cap 86 is placed over the bearing 84 so the tubular portion 204 of the end cap extends into the annular groove 62 of the spindle 20. The brushroll 10 can then be mounted in the vacuum cleaner by mounting the end caps 86 in their respective mounting structure in the nozzle of the vacuum cleaner.

Figure 5:
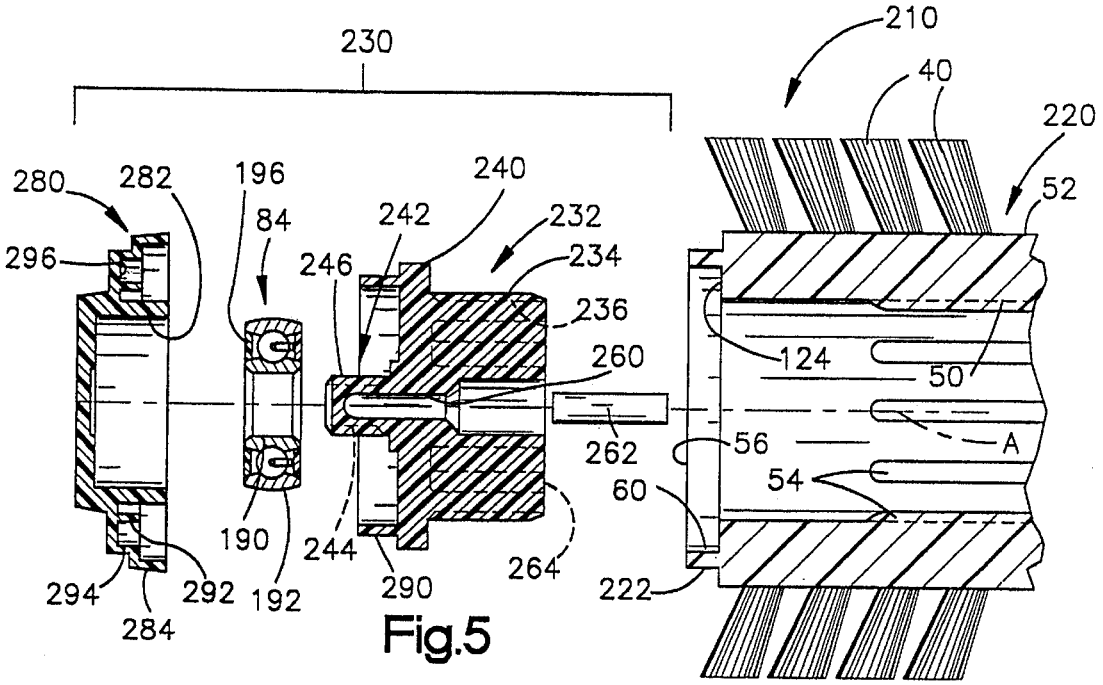
FIGS. 5–7 are views, similar to FIG. 3, of other embodiments of the present invention.

Another embodiment of a brushroll 210 of the present invention is illustrated in FIG. 5. The brushroll 210 includes a spindle 220 and a pair of substantially identical end assemblies 230 (only one of which is shown in FIG. 5). The spindle 220 is substantially the same as the spindle 20, as described above and illustrated in FIG. 3. The spindle 220 is a slightly modified version of the spindle 20 by having a reduced diameter end portion 222 at both axial ends rather than a recess 62.

Figure 4:
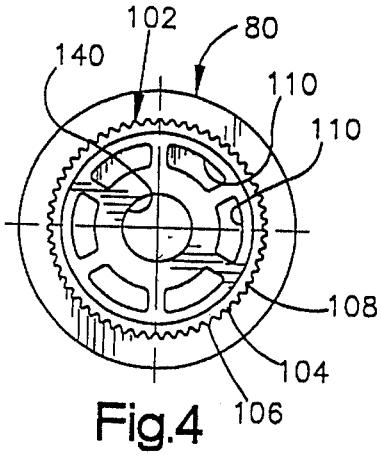
FIG. 4 is an end view of one of the components illustrated in FIG. 3, taken along the line 4—4 in FIG. 3.

The structure of the end assembly 230 of the brushroll 210 is different than the end assembly 30, described above and illustrated in FIG. 3. Each end assembly 230 (only one of which is shown in FIG. 4) includes a plug 232, a bearing 84 and an end cap 280. The bearing 84 of the end assembly 230 is the same as described above and illustrated in FIG. 3. The plug 232 and the end cap 280 have a modified structure compared to the plug 80 and the end cap 86, respectively.

The plug 232 includes a generally cylindrical outer surface 234. A plurality of circumferentially arranged ribs 236 extend longitudinally over the length of the cylindrical outer surface 234. The ribs 236 are in the form of splines, knurls or the like. The plug 232 is received in an opening in an axial end portion of the spindle 220 and the ribs 236 deformably engage the entire periphery of the inner cylindrical surface 50 defining the opening for the axial extent of the outer surface 234 to resist relative rotation. The plug 232 includes a flange 240 for engaging the axial end surface 124 of the annular recess 60 to limit how far axially inward the plug may extend into the spindle 220.

The plug 232 includes a stub shaft portion 242 extending coaxially from the flange 240 in a direction opposite the extent of the outer cylindrical surface 234. Preferably, the plug 232 and stub shaft portion 242 are integrally formed as a one piece construction from a plastic material by an injection molding operation. The plug 232 includes a plurality of circumferentially arrayed and longitudinally extending ribs 244 formed on a cylindrical outer surface 246 of the stub shaft portion 242.

The plug 232 includes a cylindrical bore 260 extending coaxially relative to the cylindrical outer surface 234 and stub shaft portion 242. The bore 260 extends axially at least partially within the stub shaft portion 242, partially within the cylindrical portion 234 and totally within the axial extent of the flange 240. A reinforcing pin 262, preferably made from a metal material, is inserted in the bore 260 in a tight fitting relationship, such as results from a press fit operation. The pin 262 serves to stiffen the one piece plastic construction of the plug 232 to resist bending of the stub shaft portion 242. The pin 262 also prevents the stub shaft portion 242 from moving transversely relative to the flange 240, the outer surface 234 and the spindle 20. A plurality of passages 264 extend longitudinally within the plug 232. The passages 264 are similar to the passages 110 in plug 80.

The stub shaft portion 242 is received in fixed frictional engagement within the inner bearing portion 190 of the bearing 84 by the ribs 244. The relatively rotatable outer bearing portion 192 of the bearing 84 is received in a cavity 282 of the end cap 280 and fixed therein. A tubular portion 284 of the end cap 280 extends over the reduced diameter end portion 222 of the spindle 220 to protect the bearing 84 from loose threads, dirt and debris caused by rotation of the spindle 20 during use. The end cap 280 is operably connectable with the mounting structure in the vacuum cleaner nozzle to support the spindle 220 for rotation.

The plug 232 and the end cap 280 may be optionally modified to include a labyrinth seal to further protect the bearing 84 from debris. The plug 232 may include a continuous annular wall 290 extending coaxially from the flange 240 in the same direction as the stub shaft portion 242. Another annular wall 292 extends from the end cap 280 coaxially relative to outer annular wall 294 to define a channel 296. The annular walls 290, 292 and 294 cooperate to form a labyrinth seal to protect the bearing 84.

Figure 6:
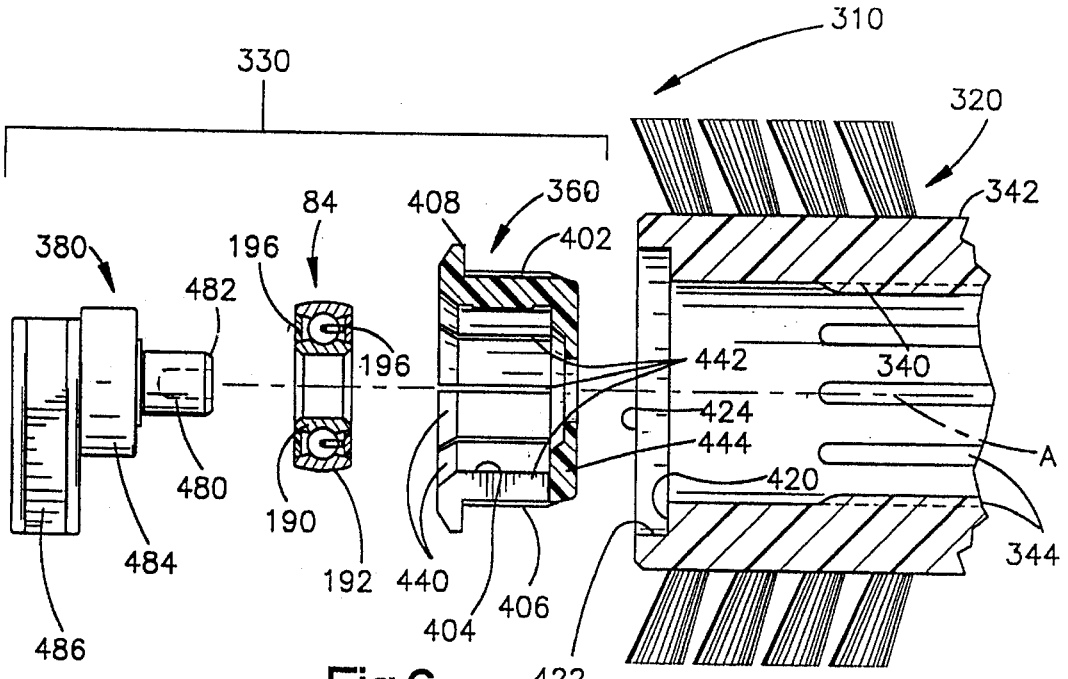

Another alternate embodiment of a brushroll 310 is illustrated in FIG. 6. The brushroll 310 includes a spindle 320 which is similar to the spindle 20 illustrated in FIG. 3 and described above. The brushroll 310 also includes a pair of substantially identical end assemblies 330 (only one of which is shown in FIG. 6).

The spindle 320 is preferably made from plastic and includes an inner cylindrical surface 340 extending longitudinally through the entire spindle and a coaxial outer cylindrical surface 342. The spindle 320 may also include a plurality of reinforcing ribs 344 similar to the reinforcing ribs 54 described above and extending for the majority of the length of the spindle. The end assembly 330 includes a plug 360, a bearing 84 identical to that described above, and an end pin mounting member 380. Thus, the end assembly 330 has only three components which require assembling together which provides relatively easy and inexpensive assembly.

The plug 360 of the end assembly 330, illustrated in FIG. 6, is preferably made from plastic. The plug 360 has an outer surface 402 of a generally cylindrical shape and a bearing cavity 404 coaxial with the outer surface. A plurality of ribs 406 are formed around the entire periphery of the outer surface 402. Each rib 406 deformably engages the plastic material of the inner cylindrical surface 340 of the spindle 320. The plug 360 and the spindle 320 are, thus, fixed together by frictional engagement and any relative rotational movement is resisted or totally eliminated. The plug 360 includes a flange 408 that engages an inner axial end surface 420 of an annular recess 422 formed in the axial end surface 424 of the spindle 320 to limit how far inwardly the plug may be inserted into the spindle.

The plug 360 also includes a plurality of arcuate sections 440. The arcuate sections 440 of the plug 360 are resiliently movable in a radial direction relative to the axis A. Each of the arcuate sections 440 is separated by a pair of slits 442 which extend completely and radially through the cylindrical outer surface 402 and the flange 408 of the plug 360. However, the slits 442 do not extend through any part of an axial end portion 444 of the plug 360. Thus, each arcuate section 440 is radially contractible as the plug 360 is inserted into engagement with the inner cylindrical surface 340 of the spindle 320 or radially expandable as the bearing 84 is received in the cavity 404. After the plug 360 is in place within the spindle 320, the axial end portion 444 of the plug acts like a spring and biases the outer surface 402 of each arcuate section 440 against the inner cylindrical surface 340 of the spindle.

The inner bearing portion 190 of the bearing 84 is received on a shaft portion 480 of the end pin mounting member 380. An axial end 482 of the shaft portion 480 is swaged to retain the bearing 84 on the shaft portion. A flange 484 of the end pin mounting member 380 opposite the axial end 482 engages an axial end of the bearing 84 to fix the position of the bearing axially along the shaft portion 480. The end pin mounting member 380 is operably connectable with a mounting structure in the vacuum cleaner nozzle at a base portion 486. Preferably, the shaft portion 480, flange 484, and base portion 486 of the end pin mounting member 380 are integrally formed as one piece, preferably by die casting of a suitable metal, such as a zinc alloy.

When the end assembly 330 is received in the end portion of the spindle 320, the bearing 84 is located inwardly of an axial end surface 424 of the spindle. The flange 484 of the end pin mounting member 380 prevents axial outward movement of the bearing 84 relative to the spindle 320 when the brushroll 310 is rotatably mounted in the vacuum cleaner nozzle. Locating the bearing 84 inwardly of the axial end surface 424 of the spindle 320 and the provision of seals 196 serves to protect the bails and races of the inner and outer bearing portions 190, 192 of the bearing 84 from debris disturbed by rotation of the spindle. Locating the bearing 84 within the spindle 320 also provides a relatively shorter and compact brushroll 310.

Figure 7:
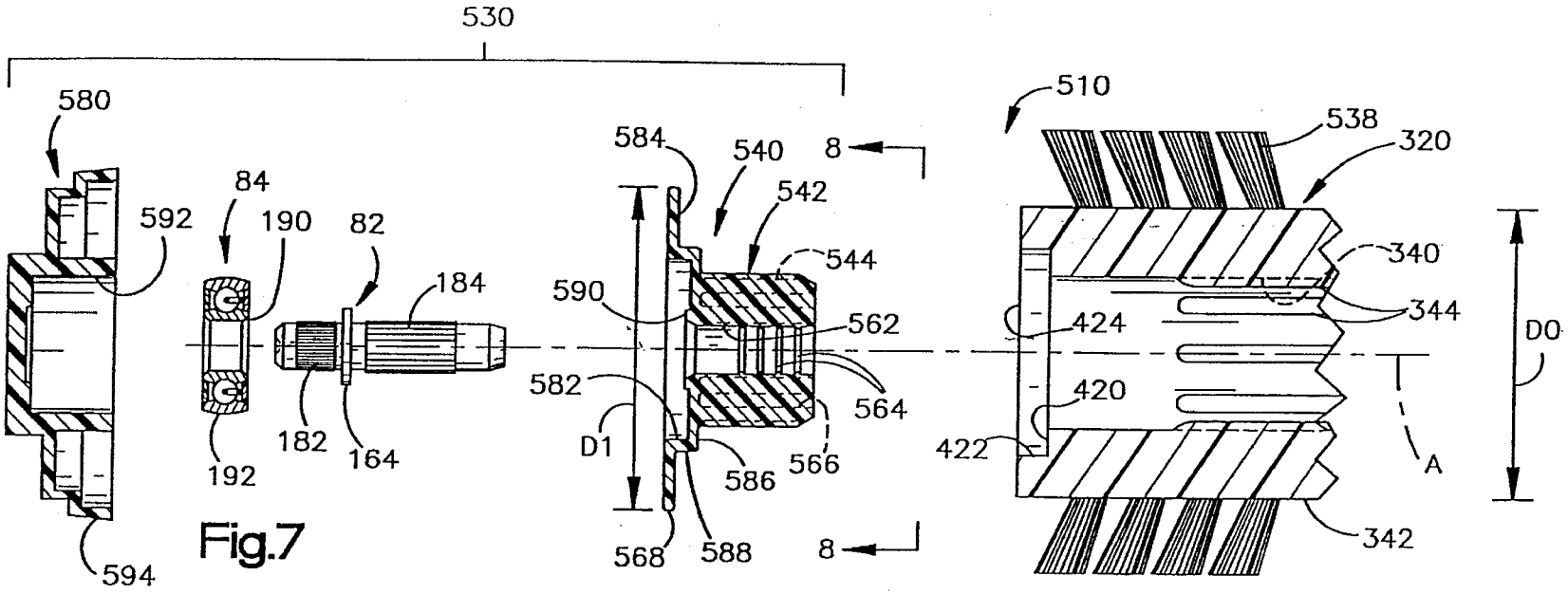

Another alternate embodiment of a brushroll 510 is illustrated in FIG. 7. The brushroll 510 includes a spindle 320 and a pair of end assemblies 530 (only one of which is shown in FIG. 7). The spindle 320 is identical to the spindle illustrated in FIG. 6 and described above. The end assembly 530 illustrated in FIG. 7 includes a stub shaft 82, a bearing 84, an end cap 580 and a plug 540. The stub shaft 82 and bearing 84 are identical to those described above and illustrated in FIG. 3. The end cap 580 is similar to the end cap 280 described above and illustrated in FIG. 5.

The spindle 320 is tufted and is in the form of a hollow tubular member. Preferably, the spindle 320 is made as one piece from a plastic material by a suitable process, such as molding. The spindle 320 has an outer cylindrical surface 342 with an outer diameter D0.

Figure 8:
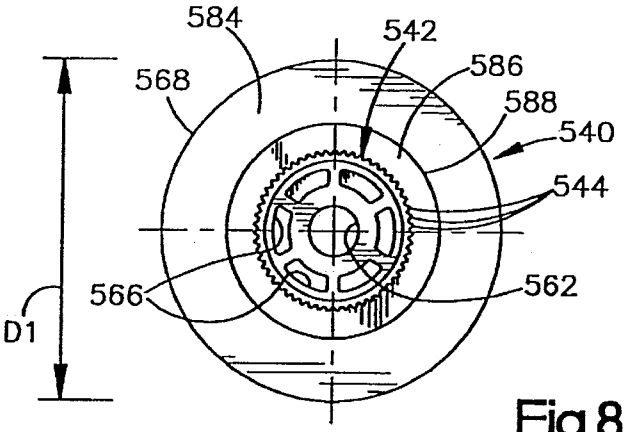
FIG. 8 is an end view of one of the components illustrated in FIG. 7, taken along the line 8—8 in FIG. 7.

The plug 540 is made from a plastic material by a suitable process, such as molding. The plug 540 includes a cylindrical outer portion 542 which extends for a majority of length of the plug. A plurality of longitudinally extending and circumferentially arrayed ribs 544 are formed about the entire outer periphery of the outer cylindrical surface 542, as illustrated in FIG. 8. The ribs 544 deformably and frictionally engage an end portion of the inner cylindrical surface 340 of the spindle 320 to resist relative rotation between the plug 540 and the spindle.

A central bore 562 extends longitudinally completely through the plug 540 and coaxially with the outer cylindrical surface 542. As best seen in FIG. 7, the bore 562 includes a plurality of annular bumps 564 which are axially spaced along the bore. The bumps 564 receive a splined portion 184 of the stub shaft 82 and deform relatively easier than the plastic material in a continuous bore, such as the bore 140 illustrated in FIG. 3, to resist relative rotation between the plug 540 and the stub shaft.

The plug 540 also includes a plurality of longitudinally extending passages 566 located radially outward of the bore 562 and inwardly of the outer cylindrical surface 542. The passages 566 extend for substantially the entire length of the outer cylindrical portion 542. The passages 566 are used to provide a relatively constant thickness of portions of the plug 540. The passages 566 are provided in the plug 540 so that after the plug is molded it cools at a relatively uniform rate to minimize any distortion which could result from non-uniform cooling in portions of the plug.

The plug 540 also includes a flange 568. The flange 568 is formed integrally with the plug 540 as one piece from a plastic material. A recess 582 is formed in the plug 540 and extends axially inwardly of the flange 568. The flange 568 has an inner axial end surface 584. The plug 540 also includes an axial end surface 586 and a cylindrical outer surface 588. The axial end surface 586 and cylindrical outer surface 588 define a portion of the recess 582.

The inner axial end surface 584 of the flange 568 engages an axial end surface 424 of the spindle 320 after the plug 540 is inserted in the axial end portion of the spindle during an assembly operation. The axial end surface 586 engages the end surface 420 of the recess 422 formed in the end of the spindle 320. The flange 568 and end surface 586 prevent the plug 540 from being inserted axially too far inwardly in the spindle 320. The outer cylindrical surface 588 of the plug 540 closely fits within the inner cylindrical surface defining the recess 422 to help in preventing movement of the plug 540 in a direction traverse relative to the spindle 320.

The flange 568 of the plug 540 has an outer diameter D1. The outer diameter D1 of the flange 568 is greater than the outer diameter D0 of the spindle 320 by at least five percent. The outer diameter D1 of the flange 568 is less than the outer diameter of the tufting 538. The flange 568 extends radially outwardly of the outer cylindrical surface 342 of the spindle 320 in order to block any debris resulting from a rotation of the spindle from moving axially outward of the spindle. By blocking axial outward movement of the debris by the flange 568, the bearing 84 of the brushroll 510 is afforded protection from the debris. The flange 568 also forms a barrier to block and stop loose threads from moving axially outward of the spindle 320 before they reach the bearing 84 and to collect any loose threads at the barrier.

The axial depth of the recess 582 is preferably larger than the axial extent of thickness of the flange portion 164 of the stub shaft 82. The flange portion 164 of the stub shaft 82 engages the axial end surface 590 of the recess. When the inner bearing 190 of the bearing 84 is received on the splined portion 182 of the stub shaft 82, a portion of the bearing is located at least partially within the recess 582 to protect the bearing from debris. The end cap 580 includes a pocket 592 for receiving the outer bearing portion 192 of the bearing 84. The end cap 580 also includes an outer annular wall 594 which extends over the flange 568 when the end assembly 530 is properly assembled in the end portion of the spindle 320. The end cap 580 is operably connectable with mounting structure in a vacuum cleaner nozzle to rotatably mount the spindle 320.

Figure 9:
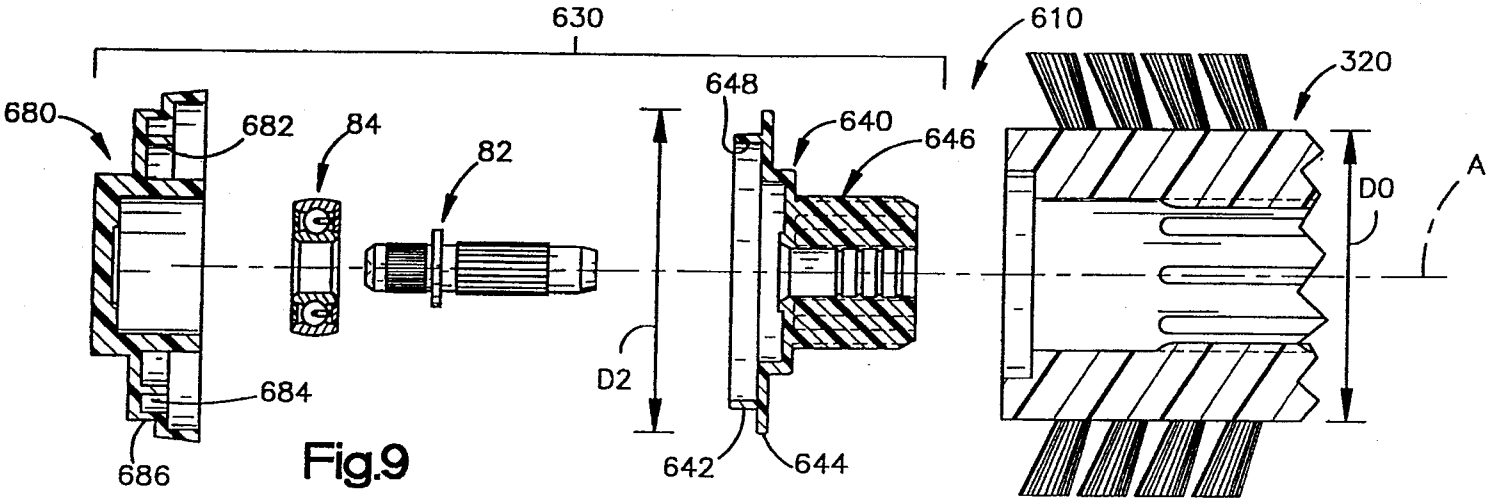
FIGS. 9 and 10 are views, similar to FIG. 3, of other embodiments of the present invention.

Another embodiment of a brushroll 610 is illustrated in FIG. 9. The brushroll 610 includes a spindle 320 and a pair of substantially identical end assemblies 630 (only one of which is shown in FIG. 9). The spindle 320 is identical to the spindle illustrated in FIGS. 6 and 7 and described above. The end assembly 630 includes a plug 640, a stub shaft 82, a bearing 84 and an end cap 680. The plug 640 and end cap 680 are slightly modified from the structure of the plug 540 and end cap 580, respectively, which are illustrated in FIG. 7 and described above. The stub shaft 82 and the bearing 84 are identical to those illustrated in FIG. 7 and described above.

The plug 640 is very similar to the structure of the plug 540. The plug 640 includes an annular wall 642 extending axially outward from a flange 644 in a direction opposite to the extent of the outer cylindrical surface 646. The outer diameter D2 of the flange 644 is greater than the outer diameter DO of the spindle 320. The annular wall 642 defines a recess 648 which is axially deeper than the recess 582 in the plug 540. This relatively deeper recess 648 provides additional protection for the bearing 84 from debris caused by rotation of the spindle 320. The annular wall 642 of the plug 640 is intended to cooperate with an annular wall 682 of the end cap 680. The annular wall 642 extends into a channel 684 in the end cap 680 defined by the annular wall 682 and outside wall 686 to form a labyrinth seal and further protect the bearing from debris.

Figure 10:
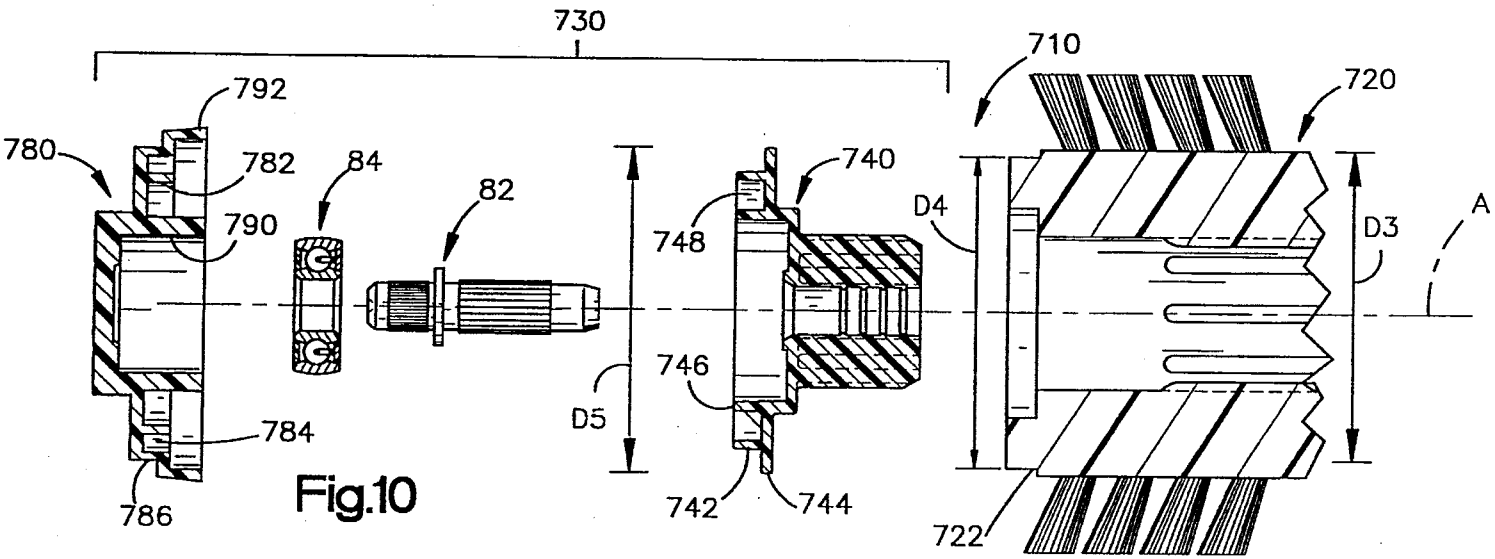

Another embodiment of a brushroll 710 is illustrated in FIG. 10. The brushroll 710 includes a spindle 720 which is similar to the spindle 320 illustrated in FIG. 9. The brushroll 710 also includes an end assembly 730. The end assembly 730 includes a stub shaft 82, a bearing 84, a plug 740 and an end cap 780. The stub shaft 82 and bearing 84 are identical to those of the end assembly 630 illustrated in FIG. 9 and described above. The plug 740 is very similar to the plug 640 illustrated in FIG. 9. The end cap 780 is very similar to the end cap 680 illustrated in FIG. 9.

The spindle 720 is a slightly modified version of the spindle 320, illustrated in FIG. 9 and described above. The spindle 720 is identical to the spindle 320 except for the addition of an annular relief 722 formed in each axial end portion of the spindle 720. The annular relief 722 may be provided in any spindle of the present invention, as needed. The outside diameter D3 of the spindle 720 is greater than the outside diameter D4 of the annular relief 722.

The plug 740 is a slightly modified version of the plug 640 illustrated in FIG. 9. The plug 740 includes a first annular wall 742 extending from a flange 744. The outer diameter D5 of the flange 744 is substantially equal to the outer diameter D3 of the spindle 720 and greater than the outer diameter D4 of the annular relief 722. The flange 744 cooperates with the annular relief 722 to form an empty space or spool area for loose threads and debris to collect at the end of the spindle 720 during rotation of the spindle. This empty space protects the bearing 84 from the loose threads and debris.

An additional feature of the plug 740 is a second annular wall 746 extending in the same direction from the flange 744 as the first annular wall 742. The first annular wall 742 and second annular wall 746 define an annular channel 748. An annular wall 782 extends from the end cap 780 into the channel 748 in the plug 740 and the annular wall 746 extends from the plug 740 into the channel 784 in the end cap to form a double labyrinth seal. The annular walls 742, 746 and annular channel 748 cooperate with the annular wall 782 in the end cap 780 to further protect the bearing 84 from debris. A recess 790 is for receiving the bearing 84 and at least partially for protecting the bearing from debris. The end cap 780 has a tubular end portion 792 which fits over the flange 744 and over the outer diameter D4 of the annular relief 722 to further seal the bearing 84 from the debris.

The brushroll 10, 210, 310, 510, 610 or 710 includes a relatively small number of parts that are relatively inexpensive to fabricate and easy to assemble. Thus, a relatively lightweight and inexpensive brushroll 10, 210, 310, 510, 610 or 710 is provided from materials that are readily available and are relatively inexpensive to obtain and fabricate.

Many variations and modifications of the invention will be apparent to those skilled in the art from the above detailed description. Therefore, it is to be understood that, within the scope of the appended claims, the invention can be practiced otherwise than as specifically shown and described.

Having described at least one preferred embodiment of the invention, what is claimed is:

1. In a vacuum cleaner brushroll including a tufted spindle supported by end assemblies having bearings that rotatably mount the spindle in a vacuum cleaner nozzle and in which rotation of the spindle is effective to pick up debris, the improvement wherein:

a) said spindle comprises a hollow tubular plastic member;

b) each of said end assemblies includes:

i) a plug member fitted into a respective axial end of said tubular plastic member, at least one of said tubular plastic member and said plug member having ribs that engage the other of said members to resist relative rotation therebetween, ii) a spindle mounting member having a first portion cooperable with brushroll mounting structure of the vacuum cleaner nozzle and a second portion for mounting a bearing, and c) each bearing of each end assembly has a first bearing portion and a second bearing portion, said first bearing portion being fixed against rotation in one of said plug member and said spindle mounting member and said second bearing portion being rotatable relative to said first bearing portion and carried by said second portion of said spindle mounting member, each said spindle mounting member and said plug member cooperating to form a bearing mounting cavity in which said bearing is enclosed to protect said bearing from debris.

2. The improvement set forth in claim 1 further including a plurality of circumferentially arrayed reinforcing ribs extending radially from an inner cylindrical surface of said tubular member and spaced from axial ends of said tubular member.

3. The improvement set forth in claim 1 further including a stub shaft for mounting said second portion of said bearing.

4. The improvement as set forth in claim 1 wherein each said plug member has ribs formed on an outer cylindrical surface for frictional engagement with the plastic material of said tubular plastic member to resist rotation between said spindle and said plug member;

a stub shaft extends from said plug member;

each said spindle mounting member comprises an end cap having a portion connectable with a brushroll mounting structure of the vacuum cleaner nozzle;

said first portion of said bearing is fixed on said stub shaft and said second portion of said bearing is rotatable relative to said first portion and fitted into said end cap; and each said end cap and said plug cooperate to define said bearing mounting cavity in which said bearing is enclosed to protect said bearing from debris.

5. The improvement as set forth in claim 1 wherein each said spindle mounting member comprises an end cap, one of said end cap and said tubular plastic member having an annular groove and the other of said end cap and said tubular plastic member having an axially projecting tubular portion engagable in said groove to enclose the bearing.

6. In a vacuum cleaner brushroll including a tufted spindle supported by end assemblies having bearings that rotatably mount the spindle in a vacuum cleaner nozzle and in which rotation of the spindle is effective to pick up debris, the improvement wherein:

a) said spindle comprises a hollow tubular plastic member;

b) each of said end assemblies includes:

i) a plug member fitted into a respective axial end of said tubular plastic member, at least one of said tubular plastic member and said plug member having ribs that engage the other of said members to resist relative rotation therebetween, said plug member having an axially extending bearing cavity;

ii) a spindle mounting member having a first portion cooperable with brushroll mounting structure of the vacuum cleaner nozzle and a second portion for mounting a bearing; and c) each bearing of each end assembly has a first bearing portion fixed against rotation in said bearing cavity and carried by said second portion of said spindle mounting member and a second bearing portion that is rotatable relative to said first bearing portion, each said spindle mounting member and said plug member cooperating to enclose the bearing in said bearing cavity and protect the bearing from debris.

7. The improvement of claim 6 wherein each said bearing is located axially inwardly of an axial end surface of the spindle.

8. The improvement of claim 6 wherein the second portion of said spindle mounting member is a shaft.

9. The improvement of claim 6 further including means associated with said plug member for permitting arcuate sections of said plug member to radially contract and expand.

* * * * *